US010280671B2

(12) United States Patent
Kirenci et al.

(10) Patent No.: US 10,280,671 B2
(45) Date of Patent: May 7, 2019

(54) FURNITURE HINGE COMPRISING A DAMPER AND A SPRING

(71) Applicant: Samet Kalip Ve Maden Esya San. Ve Tic. A.S., Istanbul (TR)

(72) Inventors: Ümit Kirenci, Esenyurt/Istanbul (TR); Ertac Capur, Deylikdüzü-Ist (TR)

(73) Assignee: Samet Kalip Ve Maden Esya San. Ve Tic. A.S. (TR)

( * ) Notice: Subject to any disclaimer, the term of this patent is extended or adjusted under 35 U.S.C. 154(b) by 0 days.

(21) Appl. No.: 15/568,905

(22) PCT Filed: May 3, 2016

(86) PCT No.: PCT/EP2016/059851

§ 371 (c)(1),
(2) Date: Oct. 24, 2017

(87) PCT Pub. No.: WO2016/177706

PCT Pub. Date: Nov. 10, 2016

(65) Prior Publication Data

US 2018/0155974 A1 Jun. 7, 2018

(30) Foreign Application Priority Data

May 4, 2015 (DE) ..... 10 2015 106 917

(51) Int. Cl.

| | |
|---|---|
| ***E05F 1/08*** | (2006.01) |
| ***E05F 5/00*** | (2017.01) |
| ***E05F 5/02*** | (2006.01) |

(52) U.S. Cl.

CPC ..... *E05F 5/006* (2013.01); *E05F 5/02* (2013.01); *E05Y 2201/21* (2013.01);

(Continued)

(58) Field of Classification Search

CPC ..... E05Y 2900/20; E05Y 2900/202; E05Y 2900/204; E05Y 2900/208; E05Y 2201/20;

(Continued)

(56) References Cited

U.S. PATENT DOCUMENTS

| | | | |
|---|---|---|---|
| 7,395,580 | B2 | 7/2008 | Brustle et al. |
| 7,874,043 | B2 | 1/2011 | Salice |

(Continued)

FOREIGN PATENT DOCUMENTS

| | | | |
|---|---|---|---|
| AT | 006499 | U1 | 11/2003 |
| AT | 502613 | A1 | 4/2007 |

(Continued)

OTHER PUBLICATIONS

International search report from corresponding PCT/EP2016/059851, dated Jul. 12, 2016, 10 pages (not prior art).

(Continued)

*Primary Examiner* — Chuck Y Mah

(74) *Attorney, Agent, or Firm* — Lucian Wayne Beavers; Patterson Intellectual Property Law, PC

(57) ABSTRACT

The invention relates to a furniture hinge comprising a stop element and a hinge cup which is pivotally connected to said stop element by means of an articulated lever, a damper being arranged in a housing, said housing being connected to the hinge cup by means of securing means, and a spring being functionally connected to the hinge cup and the stop element or the articulated lever. According to the invention, the housing comprises a spring seat by means of which said spring is secured to the housing. This achieves a damped, compact furniture hinge which has a spring to support at least the closing action, and which is easy to mount.

16 Claims, 5 Drawing Sheets

(52) U.S. Cl.
CPC ..... *E05Y 2201/214* (2013.01); *E05Y 2201/22* (2013.01); *E05Y 2201/256* (2013.01); *E05Y 2201/264* (2013.01); *E05Y 2900/20* (2013.01)

(58) Field of Classification Search
CPC ..... E05Y 2201/21; E05F 5/006; E05F 5/02; E05F 5/027; E05D 11/1021; E05D 11/1042; E05D 11/105; E05D 11/064; E05D 7/04; E05D 7/0407; E05D 7/125; E05D 3/142; Y10T 16/5383; Y10T 16/304; Y10T 16/54029
See application file for complete search history.

(56) References Cited

U.S. PATENT DOCUMENTS

| | | | | |
|---|---|---|---|---|
| 8,505,165 | B2 | 8/2013 | Domenig et al. | |
| 8,561,262 | B1 * | 10/2013 | Liang | E05F 5/006 16/286 |
| 8,650,711 | B1 * | 2/2014 | Chen | E05F 5/006 16/286 |
| 9,057,214 | B2 | 6/2015 | Salice | |
| 9,163,447 | B1 * | 10/2015 | Liang | E05F 5/006 |
| 9,366,067 | B2 | 6/2016 | Wu | |
| 9,565,941 | B2 * | 2/2017 | Peer | |
| 2007/0136990 | A1 | 6/2007 | Salice | |
| 2011/0005032 | A1 | 1/2011 | Domenig et al. | |
| 2012/0174338 | A1 * | 7/2012 | Wu | E05F 5/006 16/297 |
| 2013/0145580 | A1 * | 6/2013 | Brunnmayr | E05F 5/006 16/277 |
| 2013/0160242 | A1 * | 6/2013 | Brunnmayr | E05F 5/006 16/286 |
| 2013/0167323 | A1 * | 7/2013 | Brunnmayr | E05D 11/1014 16/50 |
| 2014/0345081 | A1 * | 11/2014 | Salice | E05F 5/006 16/50 |
| 2014/0366322 | A1 | 12/2014 | Salice | |
| 2015/0068126 | A1 * | 3/2015 | Forster | E05F 5/006 49/381 |
| 2015/0315832 | A1 | 11/2015 | Wu | |
| 2015/0337578 | A1 * | 11/2015 | Peer | E05D 3/02 49/381 |

FOREIGN PATENT DOCUMENTS

| | | | |
|---|---|---|---|
| AT | 012034 | U1 | 9/2011 |
| CN | 103953236 | A1 | 7/2014 |
| DE | 202013008364 | U1 | 10/2013 |
| WO | 2006051074 | A1 | 5/2006 |
| WO | 2009094272 | A1 | 7/2009 |
| WO | 2014067779 | A1 | 5/2014 |

OTHER PUBLICATIONS

Office action from corresponding German application 10 2015 106 917.2, dated Feb. 27, 2016, 5 pages (not prior art).

* cited by examiner

FURNITURE HINGE COMPRISING A DAMPER AND A SPRING

BACKGROUND OF THE INVENTION

1. Field of the Invention

The invention relates to a furniture hinge having a detent element and a hinge boss that by way of an articulated lever is pivotably connected to the detent element, wherein a damper is disposed in a housing, wherein the housing is connected to the hinge boss by way of fastening means, and wherein a spring is operatively connected to the hinge boss and to the detent element or to the articulated lever.

2. Description of the Prior Art

Such a furniture hinge is known from publication WO 2010/108201 A1. The furniture hinge described therein has a damper which is disposed in a housing and is operatively connected to a hinge boss and to a detent part, or to an articulated lever that connects the hinge boss and the detent part, respectively. The housing is insertable into the hinge boss from above, and in the assembled state is disposed entirely within the hinge boss. The housing herein is connected to the hinge boss by way of fastening means, preferably in the form of self-latching latching connections. A spring device presses the detent parts to a closed position, or holds them therein, respectively. To this end, the spring device is unilaterally connected to a detent part and acts on the articulated lever.

The arrangement of the damper in the housing in the hinge boss has some disadvantages. Gaps into which dust that if at all can only be removed with a great effort can intrude are thus formed between the housing and the hinge boss. The housing is preferably made of plastic. The advantages of a continuous metal surface of the hinge boss, such as, for example, high mechanical stability, easy cleaning ability, and a uniform and high-quality appeal are thus lost. Furthermore, the assembly required for the spring and for the housing having the damper leads to a considerable complexity in the assembly of the furniture hinge.

A furniture hinge in which a damper is likewise disposed entirely in the hinge boss is known from U.S. Pat. No. 8,505,165 B2. The movable parts of the damper are disposed so as to be obscured by a cover, such that said movable parts in an installed furniture hinge are no longer visible from the outside. A spring is connected to the hinge boss and is operatively connected to the opposite detent part. As a result of the additional cover, the investment in parts and thus the construction costs of the furniture hinge are increased. Furthermore, the additional components have to be disposed in the limited interior space of the hinge boss, severely restricting the available space for the damper. The separate assembly of the damper, the cover and the spring result in a high assembly complexity.

Document U.S. Pat. No. 5,604,956 describes a furniture hinge having a hinge boss and an articulated arm, in which a spring is fastened to the hinge boss and acts on the articulated arm. The spring herein is mounted outside the hinge boss and in the region of the articulation of the articulated arm is guided into the hinge boss. In order for the spring to be fixed, the latter is fastened to a mounting that is attached to the hinge boss on the external side of the hinge boss.

SUMMARY OF THE INVENTION

It is an object of the invention to provide a compact and damped furniture hinge having a spring for facilitating at least the closing movement of the furniture hinge, the latter being simple in terms of assembling.

The object of the invention is achieved in that the housing has a spring receptacle by way of which the spring is fastened to the housing. The housing assumes a dual function, specifically that of receiving the damper and that of fastening the spring. Therefore, no additional mountings or receptacles for the spring have to be provided on the hinge boss. The housing, the damper, and the spring can be fastened as a mutually tuned and preferably pre-assembled functional unit to the hinge boss. The assembly of the furniture hinge is clearly simplified on account thereof. The spring by way of the housing is connected indirectly to the hinge boss and on account thereof is operatively connected to the hinge boss.

A cost-effective production of the furniture hinge is enabled in that the spring receptacle is molded so as to be integral to the housing. The housing herein is preferably made as an injection-molded part from plastic. On account thereof, the spring receptacle without additional costs can be molded conjointly in the production of the housing.

The spring can be fastened to the housing in a particularly simple manner in that the spring receptacle is formed by a groove that is incorporated, in particular molded, in an external face of the housing, and/or in that the spring by way of a portion is plug-fitted into the spring receptacle that is configured as a groove.

According to one particularly preferred variant of design embodiment of the invention, it can be provided that the spring is formed from two leg springs that are disposed so as to be mutually opposite, that the leg springs at in each case one leg are interconnected by way of a spring bracket, and that the spring is held at the spring bracket in the spring receptacle. The spring bracket can be simply plug-fitted into a spring receptacle that is attached to the housing. The free ends of the leg springs can be guided to the articulated lever or to the detent element. On account thereof, the spring is operatively connected to the articulated lever and/or the detent element.

It can be advantageously provided that the leg springs are guided to the articulated lever laterally outside the housing. On account thereof, a spatial separation of the movable components of damper and spring is achieved.

A clear hinge boss can be achieved in that the housing is disposed outside the hinge boss and that the damper and the spring are guided through an opening into the hinge boss. On account thereof, the interior of the hinge boss in the case of the assembled furniture hinge is readily accessible and easy to clean. The surface of the hinge boss that is visible in the case of the installed furniture hinge can be made in a unitary manner, for example from metal. A uniform and high-quality appeal of the furniture hinge is achieved together with a high mechanical resilience of the surface.

The hinge boss is usually assembled in a bore which is incorporated in the furniture piece. In order for sufficient space to be provided within the bore for the housing having the damper and the spring, said housing being attached outside the hinge boss, it can be provided that the hinge boss has a centering region and an assembly region which in relation to the centering region has a reduced boss depth, and that the housing having the damper and the spring in the assembly region is fastened to the hinge boss from the outside. In the case of the installed furniture hinge, the damper per se, together with the housing and the spring thereof, is disposed behind the hinge boss, so as to be protected from external mechanical loads and from contaminants. The damper and the housing can thus be made in a cost-effective manner, for example from plastics which is soft in comparison to metal. On account of the arrangement of the housing having the damper on the assembly region, the latter having a boss depth that is reduced in relation to the centering region, the external dimensions of the functional group remain identical to those of hinge bosses of known furniture hinges, such that the hinge boss can be set and fastened in standardized bores on the item of furniture. In order for the item of furniture to be assembled, the furniture hinge is preferably made available as a pre-assembled functional unit in which the housing having the damper and the spring is already fastened to the assembly region. The furniture hinge can thus be fastened to the item of furniture in a simple and rapid manner. The centering region herein enables accurate positioning of the hinge boss in the standardized bore and thus on the item of furniture.

If it is provided that the housing toward the periphery of the hinge boss has a curved wall portion, and that the spring receptacle is incorporated as a groove in the curved wall portion, the curved wall portion can serve as a detent face. For example, in the case of a housing that is assembled outside the hinge boss, the curved wall portion can serve on a bore periphery of a bore in the furniture piece in which the hinge boss is fixed. The correct position of the hinge boss on the furniture piece herein is established by the external contour of the centering portion and of the housing. In the case of a housing that is disposed in the hinge boss, the curved wall portion can bear on an internal side of the hinge boss and thus align and fix the housing. The spring herein can be fastened in the spring receptacle. In the case of an assembled housing, the opening of the spring receptacle that is preferably embodied as a groove is advantageously covered by the bore periphery or by the internal side of the hinge boss such that the spring cannot jump out of the spring receptacle.

The operative connection between the damper and the spring in relation to the articulated lever or to the detent element in the case of a housing that is assembled outside the hinge boss can be established in that the articulated lever is pivotably mounted in the centering region of the hinge boss, that the hinge boss is open toward the assembly region, that the spring in the interior space of the centering region is guided toward the articulated lever, and that a portion of the damper protrudes into the interior space of the centering region and into the adjustment travel of the articulated lever.

A simple construction and simultaneously a good damping action can be achieved in that the damper is configured as a linear damper, in particular as a hydraulic linear damper, and that a movably mounted piston or a movably mounted cylinder of the damper protrudes into the adjustment travel of the articulated lever. When the furniture hinge is being folded inward, the articulated lever presses against the movably mounted piston or cylinder of the damper. On account thereof, the movement of the articulated lever and thus the folding movement of the furniture hinge are damped. The piston, or the cylinder, respectively, in the case of an open furniture hinge can be disposed so as to be spaced apart from the articulated lever, such that the damping effect is performed only in a last movement portion of the folding movement. Furthermore, the movably mounted piston or the movably mounted cylinder can have a ramp that faces the articulated lever, the articulated lever acting on said ramp when the furniture hinge is being folded inward. On account of the ramp, the rotating movement of the articulated lever about the rotation axis of the latter can be converted to a linear movement of the piston or of the cylinder.

The damping effect of the damper is achieved in that the cylinder is moved relative to the piston, or the piston is moved relative to the cylinder. It can therefore be provided that the cylinder is mounted so as to be movable in a linear manner in the housing and is guided into the adjustment travel of the articulated lever, and that the piston is fixed to the housing; or that the cylinder is fixed to the housing, and that the piston is mounted so as to be movable in a linear manner and is guided into the adjustment travel of the articulated lever. The damper is thus unilaterally fixed in the housing, while the movable part of the damper is guided into the adjustment travel of the articulated lever. On account thereof, the damper is preferably compressed when the furniture hinge is being folded inward, damping being performed on account thereof. In the case of a movably disposed cylinder, the latter is mounted in the housing such that no additional guiding of the cylinder is required.

Adapting an existing damper to the spatial conditions of the hinge boss can be performed in that a slider is connected to the movably mounted piston or to the movably mounted cylinder of the damper, and in that the slider is guided into the adjustment travel of the articulated lever. The force of the inward-folding articulated arm is then transmitted by way of the slider to the damper. The slider can be conceived such that said slider transforms the pivoting movement of the articulated arm to a linear movement of the cylinder or of the piston. To this end, the slider can have an oblique contact face, for example, the articulated arm in the rotating movement thereof acting on said oblique contact face.

According to one particularly preferred embodiment variant of the invention, it can be provided that the fastening elements are conceived as latching elements which interact with latching receptacles. The latching elements can be molded so as to be integral to the housing, for example. The corresponding latching receptacles can be embodied as cut-outs in the base in the assembly region of the hinge boss. In order for the housing having the damper and the spring to be assembled, the latching elements can be simply latched in the latching receptacles. A cost-effective, releasable connection that is capable of rapid assembly is thus achieved between the hinge boss and the housing having the damper and the spring.

In order to be able to set the damping action of the damper, corresponding access to the damper is required. In order for this to be enabled in the case of the damper that is disposed in the assembly region outside the hinge boss, it can be provided that the furniture hinge is assigned an adjustment element, in that the damping action of the damper is adjustable by way of the adjustment element, and that the adjustment element is accessible from the interior space of the hinge boss. The damping action can thus be set in the case of a furniture hinge that is assembled on the item of furniture.

BRIEF DESCRIPTION OF THE DRAWINGS

The invention will be explained in more detail hereunder by means of an exemplary embodiment that is illustrated in the drawings in which.

DETAILED DESCRIPTION

Figure 1:
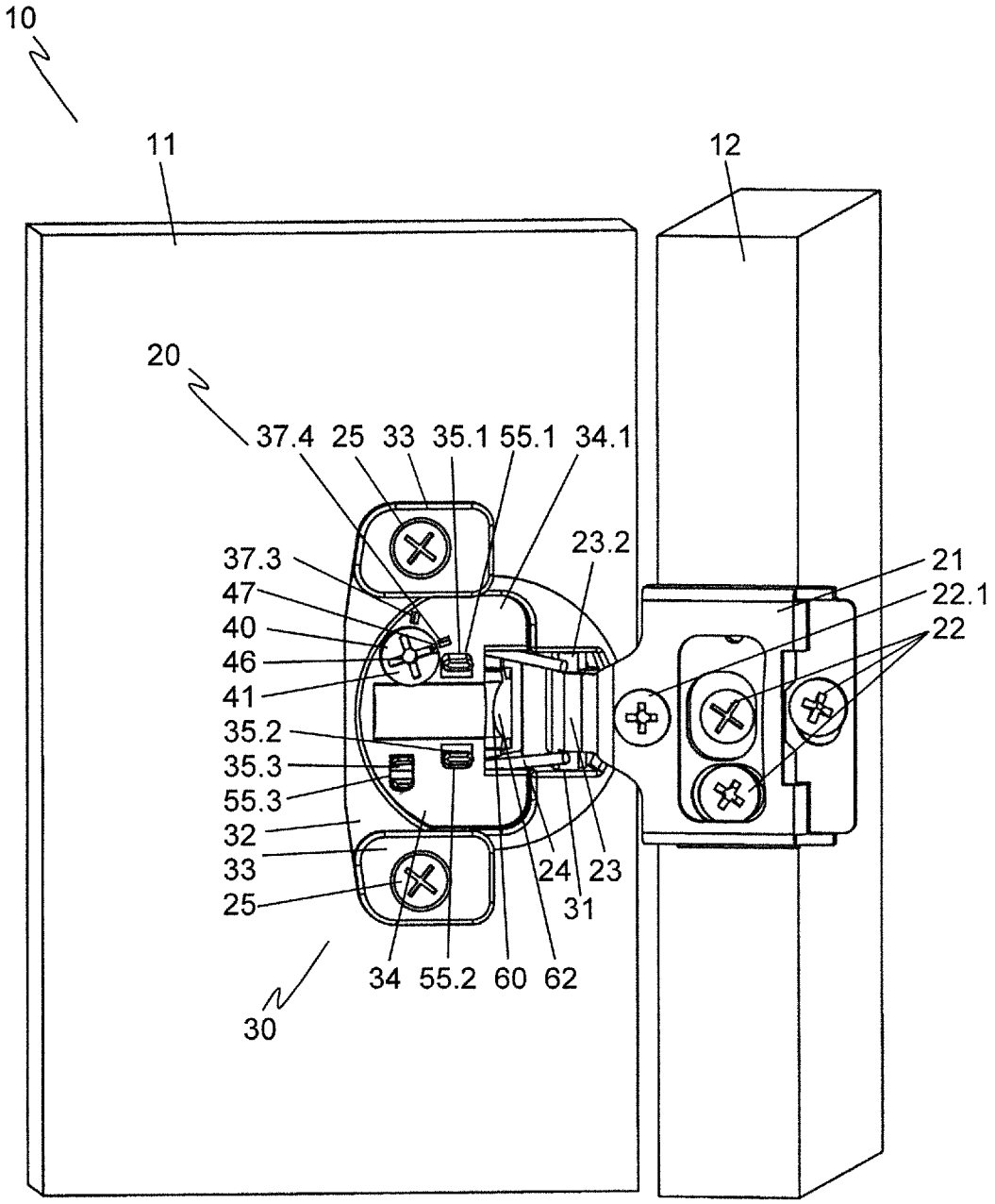
FIG. 1 shows a fragment of an item of furniture having a furniture hinge.

FIG. 1 shows a fragment of an item of furniture 10, having a furniture hinge 20. The furniture hinge 20 in a pivotable manner connects a door 11 to a frame 12 of the item of furniture 10. To this end, a detent element 21 is connected to the frame 12, and a hinge boss 30 is connected to the door 11. The detent element 21 may also be referred to as a mounting element for mounting the hinge on the frame 12. The hinge boss 30 may also be referred to as a hinge cup. The door 11 may also be referred to as a pivoted furniture part. The detent element 21 by way of assembly and adjustment elements 22 is fastened to the frame 12 and aligned therewith. The hinge boss 30 is set in a bore in the door 11, and by way of screws 25 which are guided through lateral flanges 33 that are molded laterally on the hinge boss 30 is screwed to the door 11. An articulated lever 23 which is articulated to the hinge boss 30 within a centering region 31 connects the hinge boss 30 to the detent element 21. The articulated lever 23 is screwed to the detent element 21 by way of a fastening screw 22.1. Proceeding from an external bearing face 32, the centering region 31 forms a depression which transitions to an assembly region 34 that is likewise embodied as a depression. The assembly region 34 is closed toward the door 11 by way of a base 34.1. Latching clearances 35.1, 35.2, 35.3 in the form of cut-outs are incorporated in the base 34.1. Fastening elements 55.1, 55.2, 55.3 that are embodied as latching elements are latched in the latching clearances 35.1, 35.2, 35.3. The fastening elements 55.1, 55.2, 55.3 are part of a housing 50, shown in FIGS. 2, 3, 4, and 8, for receiving a damper 60.

An adjustment element 40 is disposed within the assembly region 34. A setting head 41 of the adjustment element 40 is accessible from the open side of the hinge boss 30. Using a corresponding tool, said adjustment element 40 can be rotated by way of a crossed slot 46 that is incorporated in the adjustment head 41. A first and a second marking notch 37.3, 37.4 are incorporated in the base 34.1 of the assembly region 34. A marking 47 that is applied to the setting head 41 indicates the setting of the adjustment element 40 in relation to the marking notches 37.3, 37.4.

By way of the free ends thereof, a spring 24 is guided from the assembly region 34 into the centering region 31. The free ends of the spring 24 bear on guide curves 23.2 which are attached to the articulated lever 23. One portion of the damper 60 is introduced into the centering portion 31 and protrudes into the adjustment travel of the articulated lever 23. The adjustment travel of the articulated lever 23 may also be referred to as a path of pivotal movement of the articulated lever 23 relative to the hinge boss 30. A movably mounted cylinder 62 of a linear damper is introduced into the central portion 31 in the exemplary embodiment shown.

On account of the furniture hinge 20, the door 11 can be opened and closed in relation to a carcass of the item of furniture 10 of which only part of the frame 12 is shown. The door 11 is preferably connected to the frame 12, or to the carcass of the item of furniture 10, respectively, by way of two or a plurality of furniture hinges 20.

The spring 24 facilitates the closing procedure of the door 11, and in the exemplary embodiment shown also facilitates the opening procedure of the door 11. To this end, the free ends of the spring 24 press against the guide curves 23.2. The latter are connected to the articulated lever 23 and are shaped in such a manner that said free ends by way of the spring compression open the furniture hinge 20 from a specific opening angle to the open position of said furniture hinge 20, and from a specific closing angle presses said furniture hinge 20 to the closed position of the latter.

When the door 11 is being closed, the hinge boss 30 pivots about a rotation axis at the end of the articulated lever 23, said rotation axis being in the centering region 31. The spacing between the articulated lever 23 and the cylinder 62 of the damper 60 that has been introduced into the adjustment travel of the articulated lever 23 is reduced herein. The articulated lever 23 impacts the cylinder 62 before the closed position of the door 11 is achieved. Said cylinder 62, counter to the damping effect of the damper 60, is adjusted by the articulated lever 23. On account thereof, the movement of the door 11 is damped before the latter impacts the carcass or the frame 12, respectively. At the same time, the spring 24 by way of the guide curves 23.2 presses the door 11 to the closed position of the latter. The door 11 is thus completely closed in one damped movement.

The adjustment element 40 enables the cylinder 62 to be blocked in the retracted position of the latter. The cylinder 62 in this instance is no longer guided into the adjustment travel of the articulated lever 23, such that no damping is performed when the door 11 is being closed. This can be necessary for example when a plurality of damped furniture hinges 20 are used on one door 11. The setting head 41 of the adjustment element 40 is advantageously disposed in the interior space of the hinge boss 30. Said setting head 41 is thus accessible in the case of an assembled furniture hinge 20.

The damper 60 in the assembly region 34 is disposed outside the hinge boss 30. It is merely the cylinder 62 of the damper 60 in the centering region 31 that protrudes into the interior space of the hinge boss 30. The depth of the hinge boss 30 in the assembly region 34 is reduced so as to be less than in the centering region 31. On account thereof, a space for receiving the housing 50 having the damper 60 is formed between the base 34.1 of the assembly region 34 and the termination of the bore in the door 11, the hinge boss 30 being set in said bore. The spring 24 in the assembly region 24 is also guided outside the hinge boss 30. The accessible interior space of the hinge boss 30 in the assembly region 34 is thus clear of additional components. The base 34.1 of the assembly region 34 forms a major part of the accessible surface of the hinge boss 30. Said base 34.1 is preferably made from metal. This leads to a surface of the hinge boss 30 that is able to bear loads and is easy to clean. The damper 60 per se is disposed so as to be protected from external influences by the base 34.1.

Figure 2:
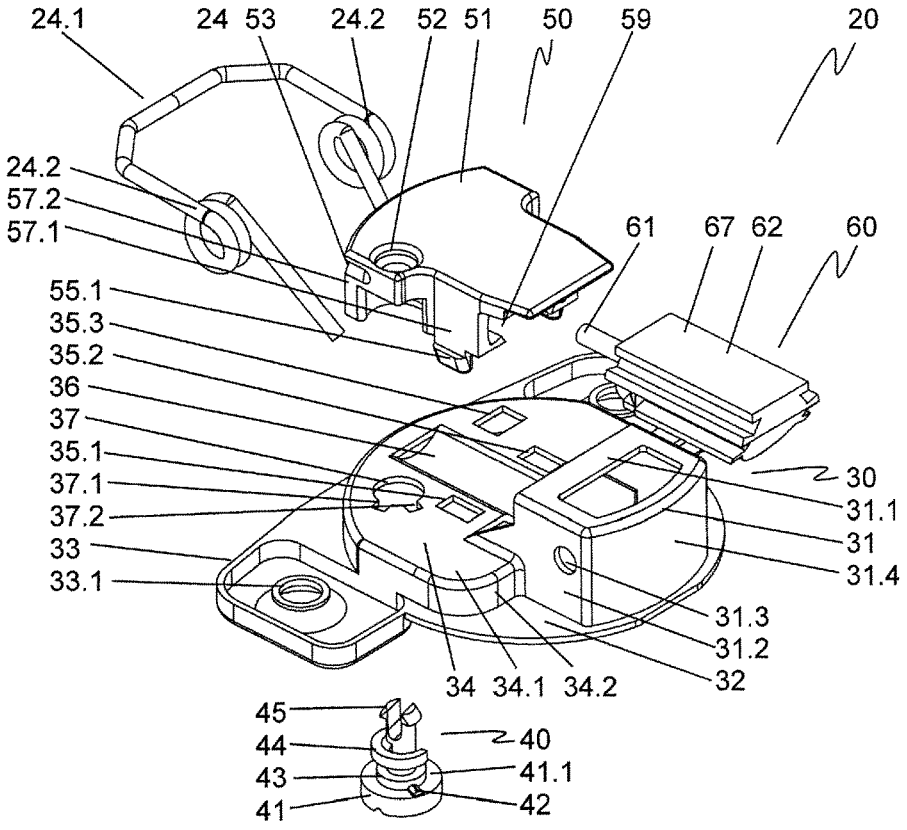
FIG. 2 shows a hinge boss of the furniture hinge in an exploded illustration in a rear view.

FIG. 2 shows the hinge boss 30 of the furniture hinge 20 in an exploded illustration in a rear view. The hinge boss 30 is formed from the assembly region 34 and from the centering region 31. Said two regions are embodied as depressions in relation to the bearing face 32.

The centering region 31 has a boss base 31.1 which by way of boss side walls 31.2 and of a rounded portion 31.4 is disposed so as to be spaced apart from the bearing face 32. In each case one articulation receptacle 31.3 is provided as cut-out in the boss side wall 31.2 shown and the opposite boss side wall 31.2. The base 34.1 of the hinge boss 30 in the assembly region 34 is spaced apart from the bearing face 32 by way of side walls 34.2. The spacing herein between the bearing face 32 and the base 34.1 of the assembly region 34 is smaller than the spacing between the bearing face 32 and the boss base 31.1 of the centering region 31.

Three latching clearances 35.1, 35.2, 35.3, preferably as rectangular cut-outs, are incorporated in the base 34.1 of the assembly region 34. A further round cut-out forms an adjustment element guide 37. A first latching receptacle 37.1 and a second latching receptacle 37.2 are disposed on the periphery of the adjustment element guide 37. The latching receptacles 37.1, 37.2 are embodied as cut-outs of the base 34.1 that are connected to the adjustment element guide 37 and from the latter point outward radially. A chamfer-shaped molding 36 is incorporated in the base 34.1 between the adjustment element guide 37 and the first latching clearance 35.1 on the one side, and between the second and the third latching clearance 35.2, 35.3 on the other side. The molding 36 is closed toward the external periphery of the assembly region 34 and is embodied so as to be open toward the centering region 31.

In a manner lateral to the assembly region 34, the lateral flanges 33 are molded opposite one another to the side walls 34.2 of the assembly region 34 and to the bearing face 32. The lateral flanges 33 have assembly bores 33.1 for receiving the screws 25 shown in FIG. 1.

The hinge boss 30 is preferably embodied as a deep-drawn part from metal.

The housing 50 is disposed opposite the assembly region 34. Said housing 50 has a housing base 51 that is cut out by a cut-out 52. The housing base 51 is connected to side wall portions 57.1 of the housing 50. The first fastening element 55.1 that is visible in the chosen perspective is molded so as to be integral to the housing 50. The housing 50 toward the periphery of the hinge boss 30 has a curved wall portion 57.2. A spring receptacle 53 is incorporated in the curved wall portion 57.2. The spring receptacle 53 herein is molded so as to be integral to the housing 50, in the present exemplary embodiment as a groove therein. The housing 50 toward the centering region 31 of the hinge boss 30 is open by way of a housing opening 59.

The damper 60 is disposed opposite the housing opening 59. The damper is preferably embodied as a hydraulic linear damper, having a piston 61 and the cylinder 62. Facing away from the hinge boss 30, the cylinder 62 has a flat cylinder face 67.

The spring 24 is assigned to the housing 50, so as to be opposite the damper 60. The spring is formed from two leg springs 24.2 which are disposed so as to be mutually opposite and connected to a spring bracket 24.1. The free ends of the leg springs 24.2 are aligned in the direction of the centering region 31.

Proceeding from the open side of the hinge boss 30, the adjustment element 40 faces the adjustment element guide 37. The adjustment element 40 along the central longitudinal axis thereof has the setting head 41, a guide portion 43, a subsequent adjustment portion 44, and a terminating first fastening element 45. The diameter of the adjustment element 40 is tapered in the transition from the setting head 41 to the guide portion 43. The face of the setting head 41 that is thus formed and faces the guide portion 43 forms a second fastening portion 41.1. A latching appendage 42 is molded on the second fastening portion 41.1. The fastening portion 41.1 and the latching appendage 42 are preferably disposed so as to be radial to the central longitudinal axis of the adjustment element 40.

For assembly, the damper 60 is inserted through the housing opening 59 into the housing 50. The spring 24 by way of the spring bracket 24.1 thereof is fixed in the spring receptacle 53 of the housing 50. The articulated lever 23 shown in FIG. 1 is pivotably fastened in the centering region 31 of the hinge boss 30. The housing 50 by way of the fastening elements 55.1, 55.2, 55.3 thereof that are embodied as latching elements is subsequently latched in the corresponding latching receptacles 35.1, 35.2, 35.3. The free ends of the spring 24 and the cylinder 62 of the damper 60 herein are introduced through an opening 38 (shown in FIGS. 5 and 6) into the interior of the centering region 31. The adjustment element 40 is plug-fitted from the internal side of the hinge boss 30 into the adjustment element guide 37 and into the cut-out 52 in the housing base 51. The first fastening portion 45 that is embodied as a latching element herein latches in the cut-out 52, while the second fastening portion 41.1 bears on the internal side of the base 34.1 of the assembly region 34. The adjustment element 40 by way of the first and of the second fastening portion 45, 41.1 is thus fixed in an axially blocked manner to the hinge boss 30 and to the housing 50. Said adjustment element 40 herein by way of the guide portion 43 is mounted so as to be rotatable in the adjustment element guide 37. Furthermore, said adjustment element 40 by way of the first fastening portion 45 is mounted so as to be rotatable in the cut-out 52 of the housing 50. The adjustment element 40 thus assumes two tasks. The damping action of the damper 60 is set by rotating the adjustment element 40, on the one hand. The housing 50 is connected to the hinge boss 30 by way of the adjustment element 40, on the other hand.

Figure 3:
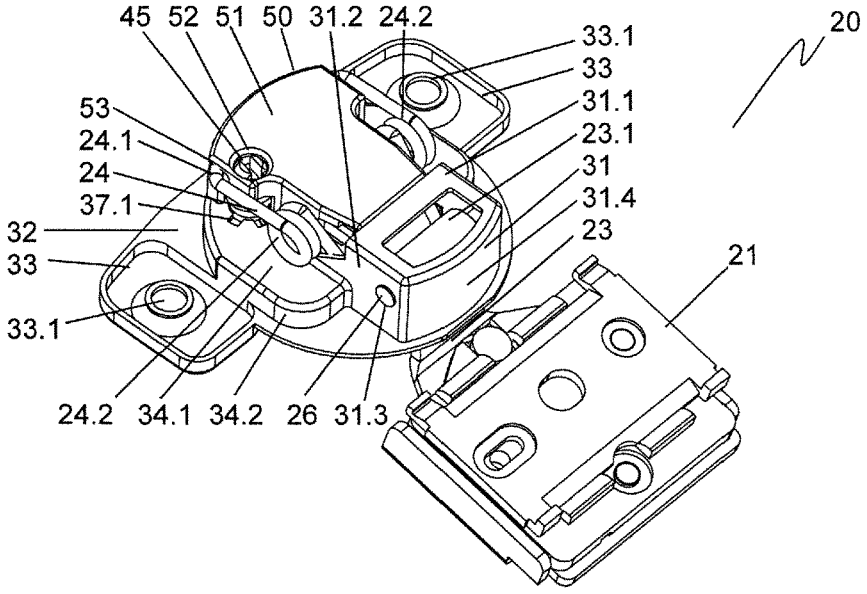
FIG. 3 shows the assembled furniture hinge in a rear view.

FIG. 3 shows the assembled furniture hinge 20 in a rear view. The detent element 21 by way of the articulated lever 23 is pivotably connected to the centering region 31 of the hinge boss 30. To this end, an articulation bolt 26 is guided through the articulation receptacles 31.3 that is incorporated in the boss side walls 31.2 of the centering region 31. A fastening portion 23.1 of the articulated lever 23 movably encloses the articulation bolt 26. On account thereof, a rotatable connection is established between the fastening portion 23.1 and the articulation bolt 26. The fastening portion 23.1 by way of the boss side walls 31.2 of the centering region 31 is held in a manner axial to the articulation bolt 26.

The housing 50 having the spring 24 and the damper 60 is fixed to the assembly region 34 of the hinge boss 30 from the outside. The housing 50 herein is fastened to the hinge boss 30 by way of the fastening elements 55.1, 55.2, 55.3, and by way of the adjustment element 40. The boss depth of the hinge boss 30 in the assembly region 34 is reduced in relation to the boss depth in the centering region 31 to the extent that the housing base 51 of the housing 50 lies in the plane of the boss base 31.1 of the centering region 31. The centering region 31, the assembly region 34, and the housing 50 form an external contour of the furniture hinge 20, said external contour being adapted to the shape of standardized bores for receiving hinge elements in items of furniture 10. The furniture hinge 34 can thus be centered and assembled in bores that are known for items of furniture 10. When assembled on the item of furniture 10, the housing base 51 of the housing 50 lies directly opposite the termination of the bore in the item of furniture 10, such that the housing 50 cannot be released from the assembly region 34 even in the case of forces that act from the outside, for example by way of the spring 24 or of the damper 60.

The spring 24 by way of the spring bracket 24.1 thereof is held in the spring receptacle 53 of the housing 50. The leg springs 24.2 are guided so as to be lateral to the housing 50. A major part of the spring 24 is thus disposed outside the hinge boss 30. Merely the free ends of the spring 24 are guided into the centering region 31 and to the guide curves 23.2 therein. On account thereof, the interior space of the hinge boss 30 in the assembly region 34 is clear of additional components and can thus be cleaned in a correspondingly easy manner. The housing 50 assumes a dual function. Said housing 50 serves for receiving the damper 60, on the one hand. The spring 24 is fastened to the housing 50, on the other hand. The housing 50 having the damper 60 introduced and the spring 24 attached can thus be fastened as a pre-assembled functional unit to the assembly region 34 of the hinge boss 30. No additional holding devices, by way of which the spring 24 has to be connected in a separate assembly step, are thus required for the spring 24 on the hinge boss 30. On account thereof, the assembly time for the furniture hinge 20 can be minimized. Furthermore, the components which transmit a force to the articulated lever 23, specifically the spring 24 and the damper 60, as a pre-fabricated functional unit, can be tuned to one another in an optimal manner.

Figure 4:
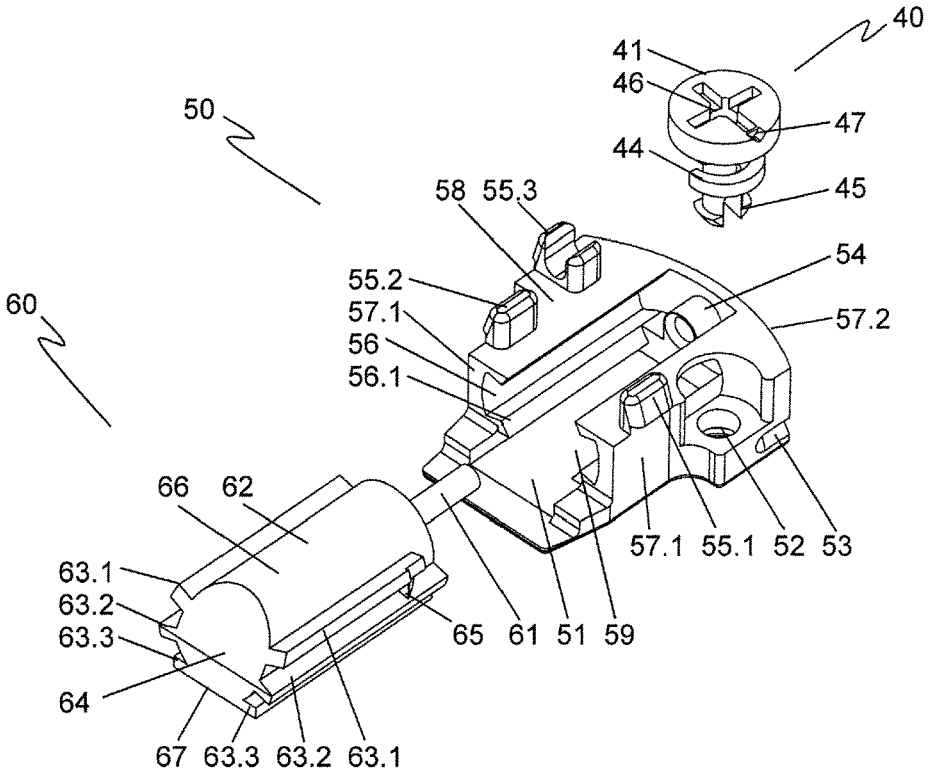
FIG. 4 shows a damper and a housing for receiving a damper, in a perspective exploded illustration.

FIG. 4 shows the damper and the housing 50 for receiving the damper 60, together with the adjustment element 40, in a perspective exploded illustration. The illustration shows the components when viewed from that side that faces the assembly region 34 of the hinge boss 30. From this side, the housing 50 is covered by a housing lid 58 that is cut out along the insertion direction of the damper 60. The housing lid 58 is connected so as to be integral to the side wall portions 57.1 and to the curved wall portion 57.2. The fastening elements 55.1, 55.2, 55.3 are molded on the housing lid 58. Two mutually opposite guide grooves 56 are formed by the housing lid 58 and by two guide webs 56.1 that are molded so as to be opposite to the housing lid 58 on the side wall portions 57.1. The guide grooves 56 are aligned in the insertion direction of the damper 60. Said guide grooves are open toward the interior space of the housing 50. A piston guide 54 is molded on the curved wall portion 57.2 toward the interior space of the housing 50. The piston guide 54 has a clearance in which the piston 61 of the damper 60 is unilaterally mountable.

The damper 60 in the insertion direction is disposed ahead of the housing opening 59 of the housing 50. To this end, the piston 61 points in the direction of the piston guide 54. The cylinder 62 is configured as a plastic molded part. A dished cylinder face 66 is disposed so as to be opposite the flat cylinder face 67. In each case three guide rails 63.1, 63.2, 63.3 are molded on both sides between the flat and the dished cylinder face 67, 66, respectively. A detent 65 is attached to that side of the cylinder 62 that faces the cut-out 52 in the housing base 51, so as to be between the first and the second guide rail 63.1 63.2. A ramp 64 is disposed on that end of the cylinder 62 that is opposite the piston 61, toward the dished cylinder face 66.

For assembly, the damper 60 is pushed into the housing 50. The first and the second guide rails 63.1, 63.2 herein engage in the guide grooves 56 of the housing 50. The third guide rails 63.3 are in each case guided in the space between the guide webs 56.1 and the housing base 51. The flat cylinder face 67 lies opposite the housing base 51. The piston 61 at the end side is plug-fitted into the piston guide 54. The piston 61 is thus mounted so as to be movable in a linear manner in the housing 50. The piston 61 is fixed to the housing 50. The cylinder 62 is adjusted in relation to the piston 61 by displacing the cylinder 62 in the direction toward the interior space of the housing 50. This causes the damping action.

Figure 5:
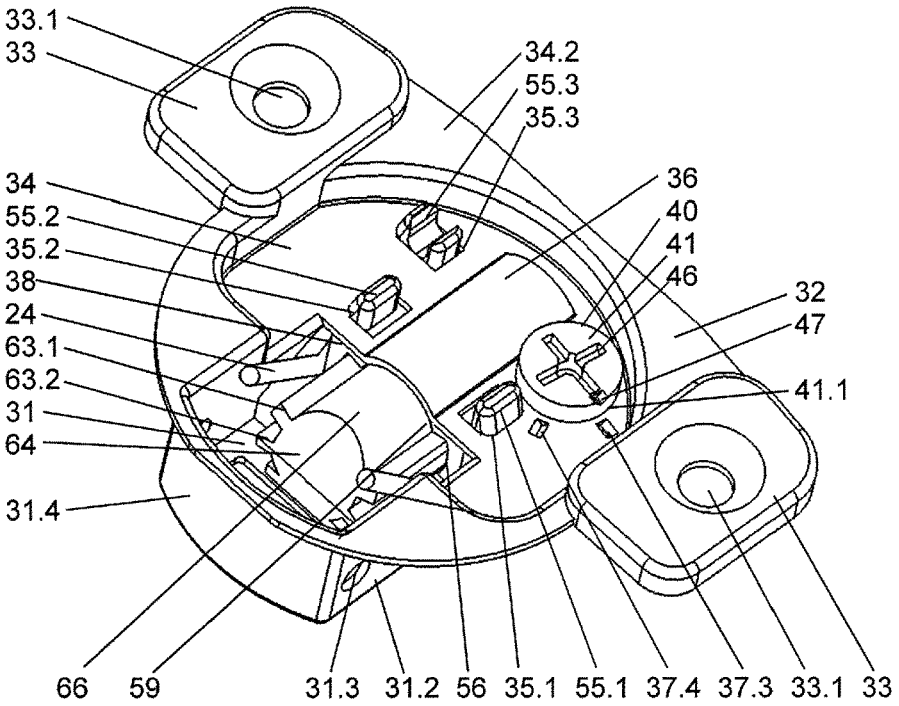
FIG. 5 shows an assembled hinge boss in a first adjustment position of an adjustment element, in a perspective front view.

FIG. 5 shows an assembled hinge boss 30 in a first adjustment position of the adjustment element 40, in a perspective front view. In this first adjustment position, the marking 47 on the setting head 41 of the adjustment element 40 points in the direction of the first marking notch 37.3. In this first adjustment position, the latching appendage 42 (shown in FIG. 2) of the adjustment element 40 latches in the first latching receptacle 37.1 (likewise shown in FIG. 2). The cylinder 62 of the damper 60 is not blocked in the first adjustment position of the adjustment element 40. Therefore, said cylinder 62 by way of that end thereof that faces away from the piston protrudes into the centering region 31 and therein into the adjustment travel of the articulated lever 23 shown in FIGS. 1 and 3. To this end, the cylinder 62 is guided through the housing opening 59 of the housing 50 and through the opening 38 in the boss side wall 31.2 of the centering region 31 into the centering region 31. The ramp 64 of the cylinder 60 is disposed such that the articulated lever 23 presses against said ramp 64 when the furniture hinge 20 is being folded inward, thus pushing the cylinder 62 counter to the damping direction of the damper 60 into the housing 50. To this end, the cylinder 62 is mounted so as to be movable in a linear manner in the guide grooves 56 of the housing 50. Additionally, the cylinder 62 by way of the dished cylinder face 66 thereof is guided in the molding 36 in the assembly region 34 of the hinge boss 30.

The free ends of the spring 24 are guided through the opening 38 in that boss side wall 31.2 of the centering region 31 that faces the assembly region 34 into the latter. The opening 38 is conceived such that the free ends of the spring 24, in addition to the cylinder 62 and so as to be lateral to the housing 50, can be guided into the centering region 31.

Figure 6:
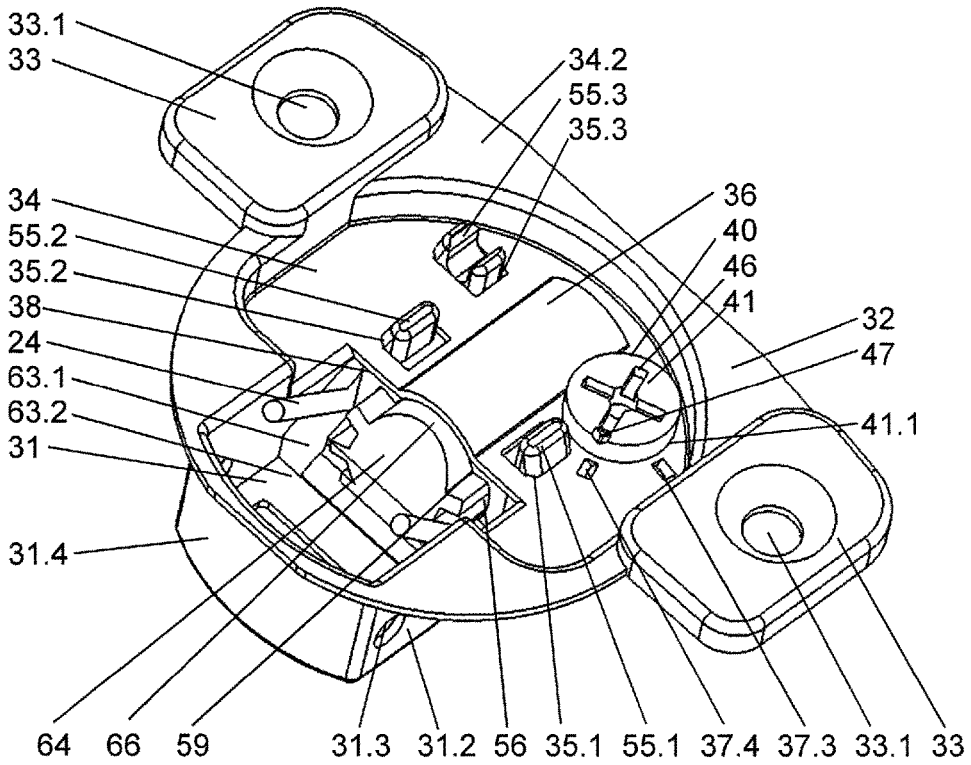
FIG. 6 shows the hinge boss shown in FIG. 5, in a second adjustment position of the adjustment element.

FIG. 6 shows the hinge boss 30 shown in FIG. 5 in a second adjustment position of the adjustment element 40. The marking 47 on the setting head 41 of the adjustment element 40 is now aligned toward the second marking notch 37.4. In this second adjustment position, the latching appendage 42 (shown in FIG. 2) of the adjustment element 40 is latched in the second latching receptacle 37.2 (likewise shown in FIG. 2). The cylinder 62 of the damper 60 in the second adjustment position of the adjustment element 40 is blocked in the retracted position of said cylinder 62. To this end, a detent face of the adjustment portion 44 of the adjustment element 40 bears on the detent 65 of the cylinder 62. The latching appendage 42 that is latched in the second latching receptacle 37.2 prevents the cylinder 62 deploying and herein rotating the adjustment element 40 in the direction of the first adjustment position.

The cylinder 62 in this second adjustment position does not protrude into the adjustment travel of the articulated lever 23 shown in FIGS. 1 and 3. The movement of the furniture hinge 20 is thus not damped when being folded inward.

Figure 7:
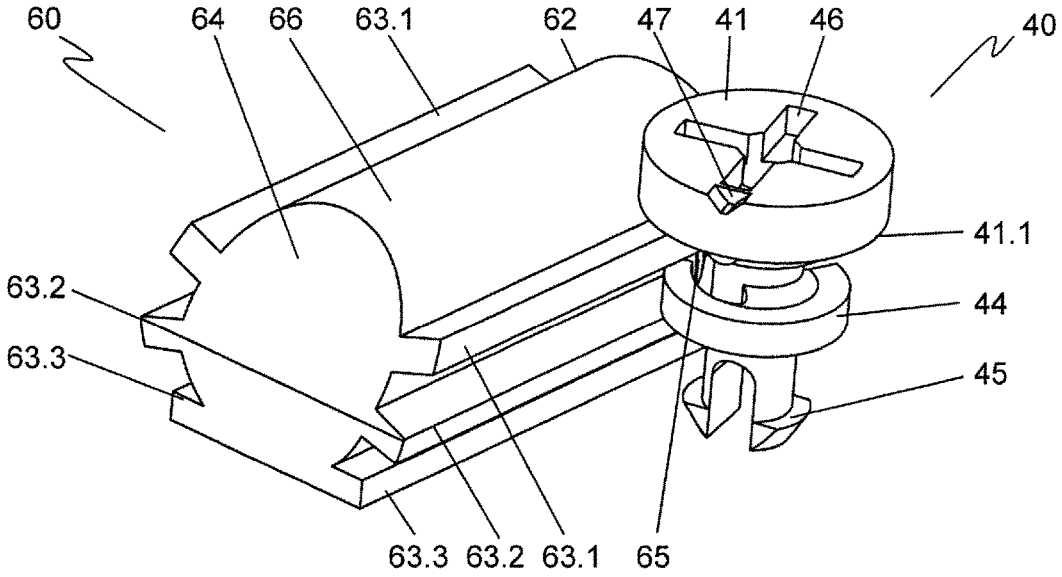
FIG. 7 shows the interaction between the damper and the adjustment element, in a perspective illustration.

FIG. 7 shows the interaction between the damper 60 and the adjustment element 40 in a perspective illustration. To this end, the damper 60 and the adjustment element 40 are shown without the surrounding components.

The adjustment element 40 is rotated to the second adjustment position thereof. The adjustment portion 44 forms a ring that is not closed. The ring at the end side has a detent face. The adjustment portion 44 in the second adjustment position is guided between the first and the second guide rail 63.1, 63.2 in such a manner that the detent face of the adjustment portion 44 bears on the detent 65 of the cylinder 62. On account thereof, the cylinder 62 is blocked in terms of the linear movement thereof. The adjustment portion 44 and the detent 65 are disposed such that the cylinder 62 is blocked in the retracted position thereof. The cylinder 62 thus no longer protrudes into the adjustment travel of the articulated lever 23, and the movement of the furniture hinge 20 is no longer damped.

Figure 8:
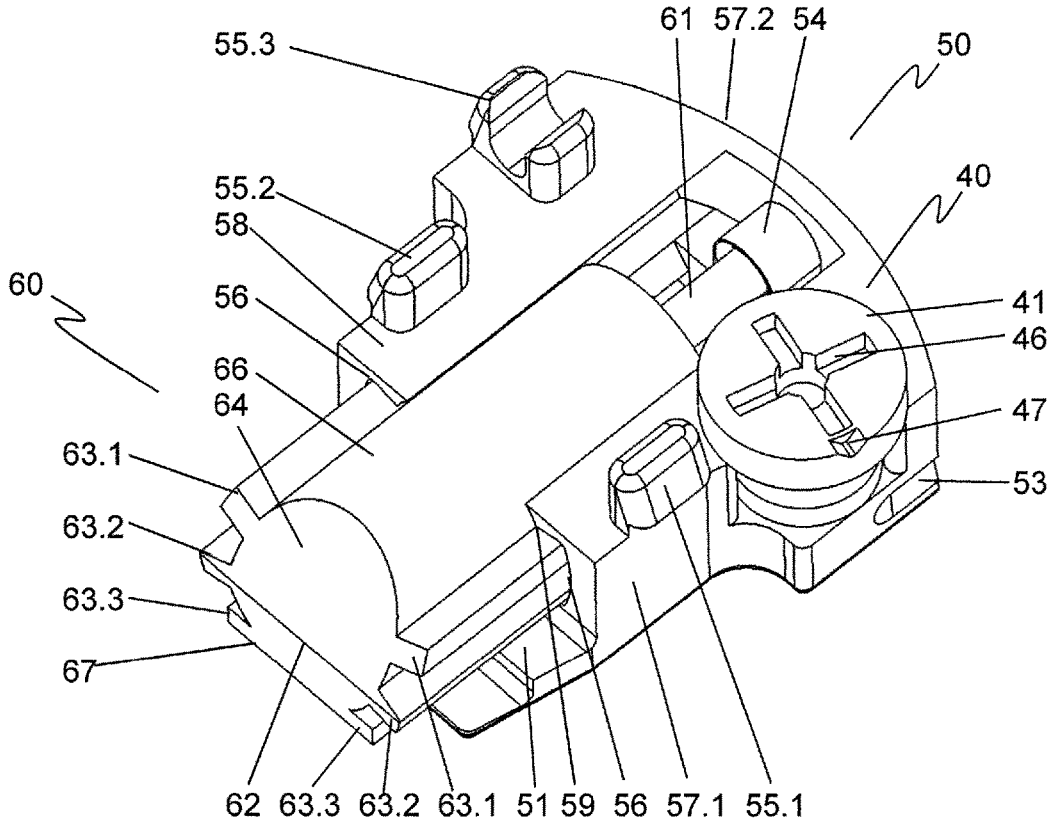
FIG. 8 shows the housing having the damper and the adjustment element.

FIG. 8 shows the housing 50 having the damper 60 and the adjustment element 40. The adjustment element 40 is rotated to the first adjustment position thereof, such that the cylinder 62 is released. The cylinder 62 thus launches itself from the piston that is fixed in the piston guide 54, the former protruding from the housing opening 59. Should the articulated lever 23 (shown in FIGS. 1 and 3) press against the ramp 64 of the cylinder 62, the latter is displaced in the direction of the piston 61 that is fixed in the piston guide 54. The inward-folding movement of the furniture hinge 20 is damped on account thereof.

The furniture hinge 20 in the exemplary embodiment shown is formed from the hinge boss 30, the detent element 21, and the articulated lever 23. However, any other fastening possibility, for example a second non-damped hinge boss 30, can be provided instead of the detent element 21.

The invention claimed is:

1. A furniture hinge for articulated fastening of a pivoted furniture part to a furniture carcass, the furniture hinge comprising:

a mounting element configured to be fastened to the furniture carcass;

a hinge cup configured to be fastened to the pivoted furniture part;

an articulated lever connected to the mounting element and pivotably connected to the hinge cup;

a housing fastened to the hinge cup, the housing including a spring receptacle formed by a groove in the housing;

a damper disposed in the housing and protruding into a path of pivotal movement of the articulated lever relative to the hinge cup, the damper being configured to dampen at least a portion of a closing pivotal movement of the articulated lever relative to the hinge cup; and a spring including two leg springs interconnected by a spring bracket, the spring bracket being received in the groove of the spring receptacle, the two leg springs being operatively associated with the articulated lever.

2. The furniture hinge of claim 1, wherein:

the groove is molded in an external face of the housing.

3. The furniture hinge of claim 1, wherein:

the spring bracket is plug-fitted into the groove of the spring receptacle.

4. The furniture hinge of claim 1, wherein:

the spring receptacle is integrally molded into the housing.

5. The furniture hinge of claim 1, wherein:

the leg springs extend laterally outside the housing into engagement with the articulated lever.

6. The furniture hinge of claim 1, wherein:

the housing is located outside the hinge cup; and the damper and the spring extend through an opening into the hinge cup.

7. The furniture hinge of claim 1, wherein:

the hinge cup includes a centering region and an assembly region, the assembly region having a cup depth that is reduced in comparison to a cup depth of the centering region; and the housing is located outside the hinge cup and is fastened to the hinge cup in the assembly region.

8. The furniture hinge of claim 7, wherein:

the articulated lever is pivotably mounted in the centering region of the hinge cup;

the hinge cup is open between the centering region and the assembly region;

the spring extends into an interior space of the centering region and engages the articulated lever; and a portion of the damper protrudes into the interior space of the centering region and into the path of pivotal movement of the articulated lever relative to the hinge cup.

9. The furniture hinge of claim 1, wherein:

the housing includes a curved wall portion, and the groove of the spring receptacle is located in the curved wall portion.

10. The furniture hinge of claim 1, wherein:

the damper is a linear damper including a piston and a cylinder, and the piston or the cylinder protrudes into the path of pivotal movement of the articulated lever relative to the hinge cup.

11. The furniture hinge of claim 10, wherein:

the damper is a hydraulic linear damper.

12. The furniture hinge of claim 10, wherein:

one of the piston and the cylinder is movable in a linear manner relative to the housing into the path of pivotal movement of the articulated lever, and the other of the piston and the cylinder is fixed to the housing.

13. The furniture hinge of claim 1, wherein:

the housing includes a plurality of latching elements; and the hinge cup includes a plurality of latching receptacles, the latching elements being received in the latching receptacles to fasten the housing to the hinge cup.

14. The furniture hinge of claim 1, further comprising:

an adjustment element accessible from an interior space of the hinge cup, the adjustment element being configured to block a damping action of the damper.

15. The furniture hinge of claim 1, wherein:

the articulated lever has two guide curves defined thereon; and the leg springs each have a free end, the free ends of the leg springs engaging the guide curves of the articulated lever.

16. The furniture hinge of claim 15, further comprising:

the guide curves and the leg springs are configured such that from a specific closing angle the leg springs press the articulated lever to a closed position relative to the hinge cup.

* * * * *